US010763632B2

(12) United States Patent
O'Connor et al.

(10) Patent No.: US 10,763,632 B2
(45) Date of Patent: Sep. 1, 2020

(54) SINGLE COMPRESSION MULTIPLE IMPRESSION CRIMP TOOL

(71) Applicant: Cupertino Electric, Inc., San Jose, CA (US)

(72) Inventors: James O'Connor, Half Moon Bay, CA (US); Bruce Baxter, San Jose, CA (US); Brandon Gries, Madison, WI (US); Peter Vierhus, San Jose, CA (US)

(73) Assignee: Cupertino Electric, Inc., San Jose, CA (US)

( * ) Notice: Subject to any disclaimer, the term of this patent is extended or adjusted under 35 U.S.C. 154(b) by 228 days.

(21) Appl. No.: 15/689,371

(22) Filed: Aug. 29, 2017

(65) Prior Publication Data

US 2018/0076592 A1 Mar. 15, 2018

Related U.S. Application Data

(60) Provisional application No. 62/393,921, filed on Sep. 13, 2016.

(51) Int. Cl.
*H01R 43/048* (2006.01)
*B21D 39/04* (2006.01)

(52) U.S. Cl.
CPC ..... *H01R 43/0486* (2013.01); *B21D 39/046* (2013.01); *B21D 39/048* (2013.01)

(58) Field of Classification Search
CPC .. H01R 43/04; H01R 43/048; H01R 43/0486; B21D 39/048; H01L 2924/00; H01L 2924/00014; Y10T 29/49181; Y10T 29/49185; Y10T 29/53235
See application file for complete search history.

(56) References Cited

U.S. PATENT DOCUMENTS 697,287 A * 4/1902 Spaulding ..... B30B 15/0029 100/257
3,643,303 A * 2/1972 Kanarek ..... B44B 5/009 101/28
3,883,938 A * 5/1975 Schmidt ..... B21F 15/00 29/715
3,931,726 A * 1/1976 Grubb ..... B21J 7/26 72/430
4,785,656 A * 11/1988 Kennedy ..... H01R 43/058 29/237
4,796,461 A 1/1989 Mead
4,954,067 A 9/1990 Brussel
5,062,290 A 11/1991 Hoover
5,257,525 A * 11/1993 Clarke ..... B21D 39/046 29/237

(Continued)

OTHER PUBLICATIONS

PCT International Search Report and Written Opinion, PCT Application No. PCT/US17/49175, dated Nov. 16, 2017, 15 pages.

(Continued)

*Primary Examiner* — Shelley M Self
*Assistant Examiner* — Katie L. Parr
(74) *Attorney, Agent, or Firm* — Fenwick & West LLP

(57) ABSTRACT

A crimp tool is disclosed that creates a plurality of impressions on a connector to secure metal to the connector using a single compression of the connector. The crimp tool includes a plurality of die. Each die including a plurality of impression teeth used to create the plurality of impressions on the connector.

17 Claims, 10 Drawing Sheets

(56) References Cited

U.S. PATENT DOCUMENTS

| | | | | |
|---|---|---|---|---|
| 5,353,623 | A * | 10/1994 | Bobenhausen | B21D 39/048 29/237 |
| 5,720,197 | A * | 2/1998 | Grau | B21D 39/048 72/402 |
| 6,026,562 | A * | 2/2000 | McMillin | H01R 43/055 29/33 M |
| 6,234,000 | B1 * | 5/2001 | Bowling | B21D 3/16 29/402.19 |
| 7,124,619 | B1 | 10/2006 | Lefavour et al. | |
| 8,631,676 | B2 * | 1/2014 | Gray | B21D 39/046 72/412 |
| 9,073,188 | B2 * | 7/2015 | Jarvi | B30B 1/18 |
| 2008/0141753 | A1 * | 6/2008 | Wightman | H01R 43/058 72/416 |
| 2012/0216591 | A1 * | 8/2012 | Seghi | B21D 39/048 72/402 |
| 2013/0240228 | A1 | 9/2013 | Lefavour et al. | |
| 2013/0263447 | A1 * | 10/2013 | Adcock | H01R 43/00 29/869 |
| 2014/0260503 | A1 | 9/2014 | Therrien | |
| 2016/0211635 | A1 | 7/2016 | Hamm et al. | |
| 2017/0179616 | A1 * | 6/2017 | Anma | H01R 43/048 |

OTHER PUBLICATIONS

"Circular Butting Twin Die," Burndy, Jul. 16, 2010, 4 pages.

"Crimp Connection," Wikipedia, May 2, 2016, 2 pages, [Online] Retrieved from the Internet<URL:https://en.wikipedia.org/wiki/Crimp_connection>.

"Catalog 407" Grainger Inc., Feb. 1, 2016, 10 pages, [publication date evidenced by "The Wonders of Industrial-Supply Catalogs" (The Paris Review) Jul. 15, 2014, available at <https://www.theparisreview.org/blog/2014/07/15/power-tools/>], [Online] Retrieved from the Internet<URL:https:www.grainger.com/>.

* cited by examiner

SINGLE COMPRESSION MULTIPLE IMPRESSION CRIMP TOOL

CROSS-REFERENCE TO RELATED APPLICATION

This patent application claims the benefit of U.S. Provisional Patent Application No. 62/393,921 filed on Sep. 13, 2016, which is incorporated by reference in its entirety.

TECHNICAL FIELD

The embodiments described herein relate to crimping tools.

BACKGROUND

A crimping tool is a device that joins one or more pieces of conductors to a connector by deforming the conductor in a manner that causes the conductor to be secured to the connector. The one or more pieces of conductor may be joined together via a connector such as a compression lug. The compression lug includes a barrel with a hole at one end of the barrel for receiving a conductor such as wiring or cable. The other end of the barrel may terminate into a terminal that can be secured to a circuit or to a terminal of another compression lug. Alternatively, rather than terminating into a terminal, the other end of the barrel may include another hole for receiving another piece of wiring or cable.

A crimp tool is used to crimp the barrel of the compression lug to secure the compression lug to the conductor inserted into the compression lug. For example, a Y46 industry standard crimping tool is used to crimp the barrel of the compression lug. Generally, conventional Y46 industry standard crimp tools include a die that creates an impression on the compression lug in order to secure the compression lug to the conductor inserted into the compression lug.

To create the impression, a conventional Y46 standard crimp tool applies force to the die which is pressed on the compression lug to create a single impression on the compression lug. However, a single impression on the compression lug is insufficient to adequately secure the conductor to the compression lug. Thus, a conventional Y46 standard crimp tool must apply multiple compressions using the die to create multiple impressions on the compression lug that are sufficient to secure the conductor to the compression lug. Since multiple compressions must be applied to the compression lug, the impressions on the compression lug may be unevenly spaced due to human error in repositioning the compression lug for each compression. Accordingly, conventional Y46 standard crimp tools are inefficient and inaccurate.

SUMMARY

The embodiments herein describe a crimp tool used to crimp metal. The crimp tool applies a single compression on a connector to create multiple impressions on the connector that are sufficient to secure the connector to conductor that is inserted into the connector. In one embodiment, the crimp tool includes a plurality of die. Each die includes a plurality of impression teeth that are used to make multiple impressions on the connector using a single compression of the plurality of die. As pressure is applied to the plurality of die, multiple impressions are formed around the connector as the plurality of die clamp around the connector thereby securing the connector to the conductor that is inserted into the connector.

The figures depict, and the detail description describes, various non-limiting embodiments for purposes of illustration only. One skilled in the art will readily recognize from the following discussion that alternative embodiments of the structures and methods illustrated herein may be employed without departing from the principles described herein.

DETAILED DESCRIPTION

The embodiments herein describe a crimp tool used to crimp metal. More specifically, the present disclosure is described with respect to an electrical compression lug crimp tool. However, the embodiments herein may be applicable to any other crimp tool that requires multiple impressions to secure a conductor to a connector.

In one embodiment, the crimp tool can apply a single compression to a connector to create multiple impressions on the connector that are required to secure the connector to a conductor that is inserted into the connector. Since the crimp tool can make multiple impressions on the connection through a single compression of the connector, the crimp tool can create more uniform impressions on the connector compared to conventional Y46 standard hydraulic crimp tools and are more efficient than conventional Y46 standard hydraulic crimp tools since only a single compression of the crimp tool is required to create multiple impressions.

Single Compression, Multiple Impression Crimp Tool

Figure 1A:
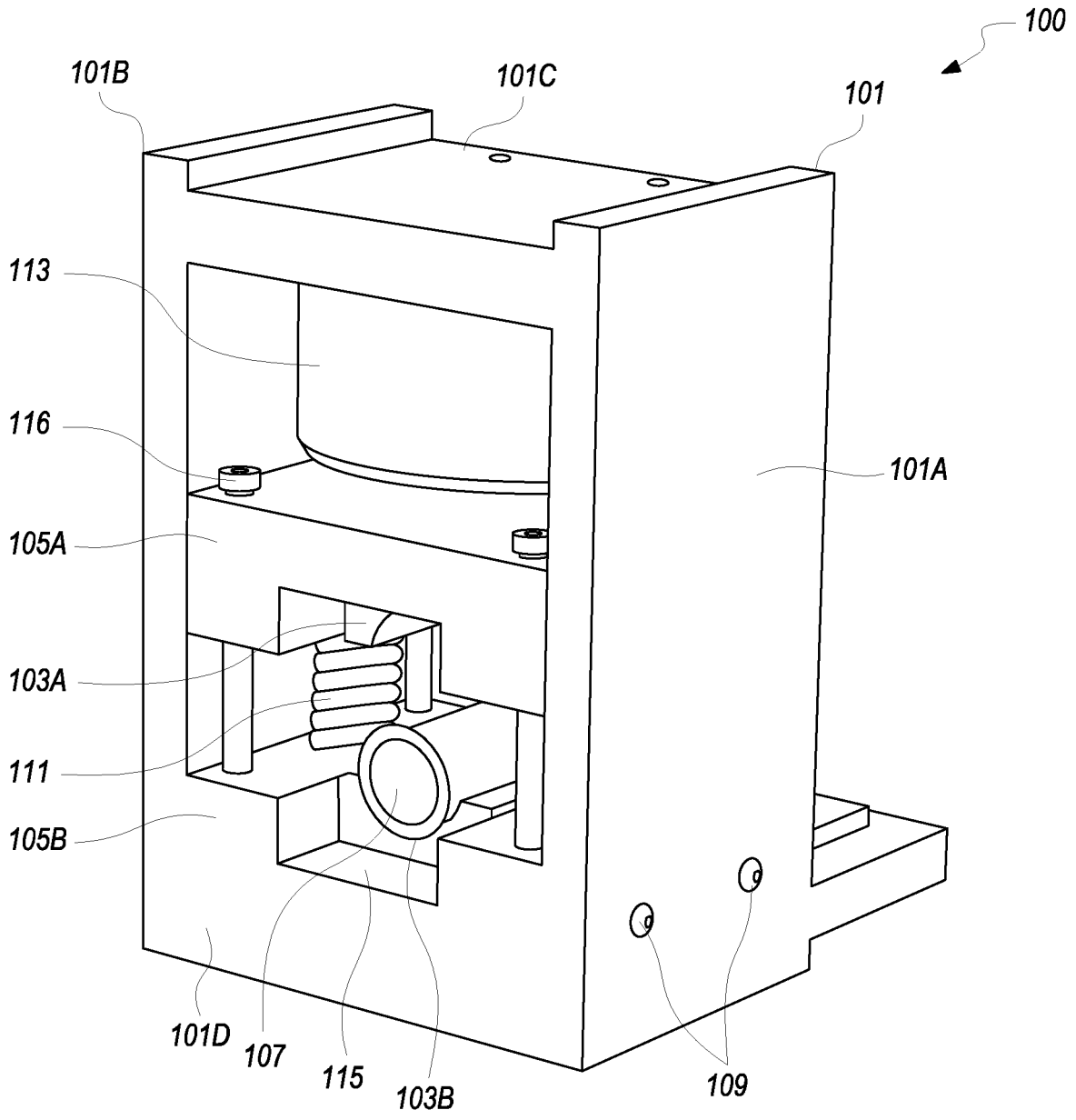
FIG. 1A illustrates an isometric frontal view of a crimping tool according to one embodiment.
Figure 1B:
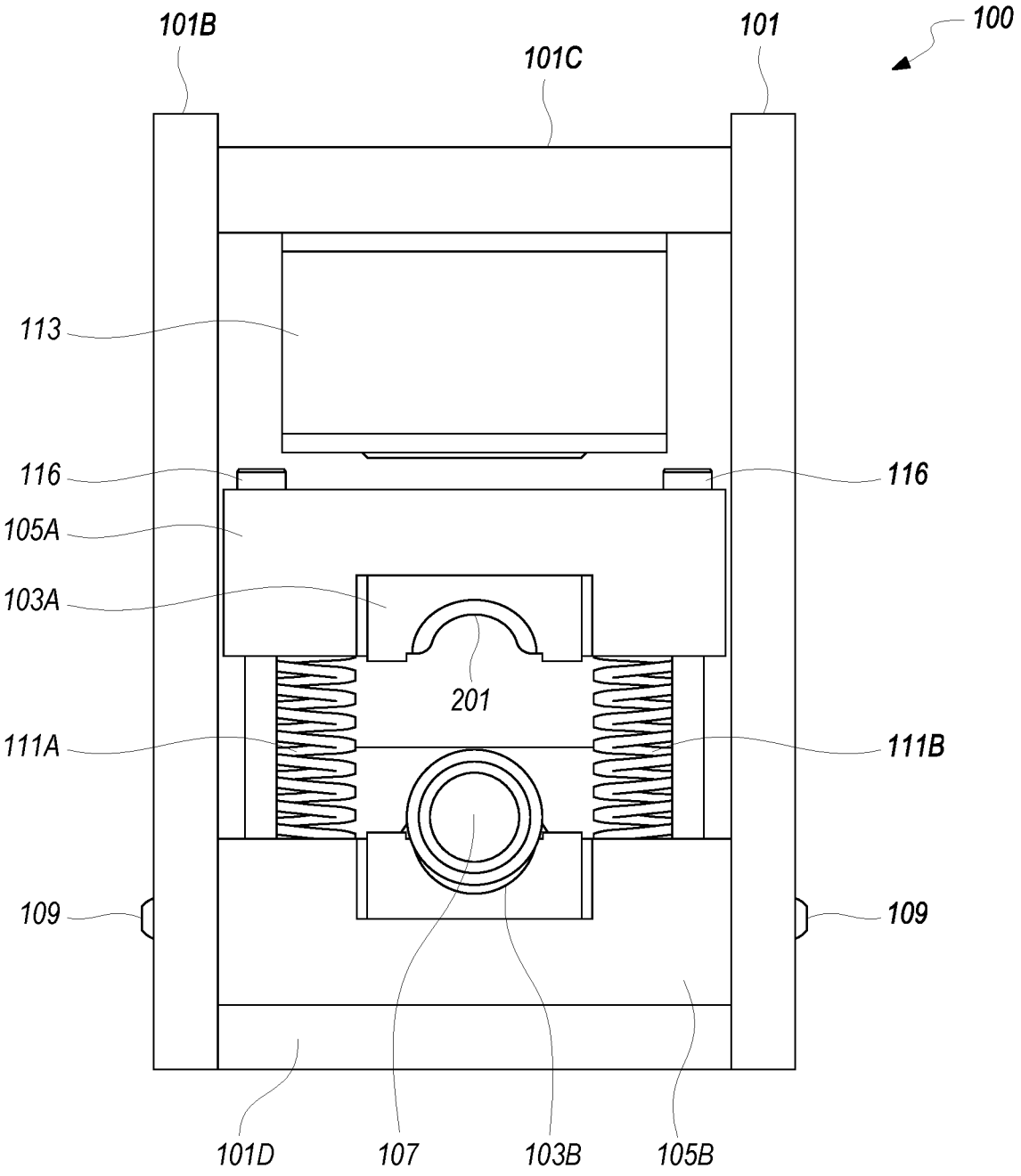
FIG. 1B illustrates a front view of the crimping tool in the open position according to one embodiment.

FIGS. 1A and 1B respectively show an isometric frontal view and a frontal view of a crimp tool 100 while in the open position according to one embodiment. The crimp tool 100 can be configured in an "open" position or a "closed" position. While in the open position, the crimp tool 100 is ready to receive a connector for crimping according to one embodiment. While in the closed position, the crimp tool 100 applies pressure on the connector positioned within the crimp tool 100 to create multiple impressions on the connector using a single compression of the connector. In other words, while in the closed position the crimp tool 100 creates crimps on the connector that secure the connector to wiring or cable that is inserted into the connector.

The crimp tool includes a housing 101. The housing 101 is the frame of the crimp tool that supports the different components of the crimp tool 100 that are within the housing 101. Generally, the housing 101 is made of metal such as steel, but other metals can be used in other embodiments.

In one embodiment, the housing 101 includes multiple walls 101A, 101B, 101C, and 101D. Wall 101A is the right wall of housing 101 and wall 101B is the left wall of housing 101. Wall 101A and wall 101B may each be a ¾ inch metal plate with a length of 11⅛ inches and a width of 5¼ inches, for example. Wall 101C is the top wall of housing 101 and may be a 1 inch metal plate with a length of 6 inches and width of 5¼ inches, for example. Wall 101D is the bottom wall of housing 101 and may be a ¾ inch metal plate with a length of 10 inches and a width of 5¼ inches, for example.

As shown in FIGS. 1A and 1B, the housing 101 is made of multiple pieces that are secured together via fasteners such as screws, rivets, or nuts and bolts. While the walls 101 are connected to each other, the housing has a rectangular shape. Note that in other embodiments, the housing 101 is formed of a single piece of metal rather than from multiple metal plates. For example, a single piece of metal may be milled to form the housing 101 rather than use multiple pieces of metal to form the housing 101.

The crimp tool 100 also includes a plurality of die 103 that create impressions on a connector 107 (e.g., a compression lug) that is placed in the crimp tool 100. Specifically, the crimp tool 100 includes an upper die 103A and lower die 103B. The upper die 103A is positioned over the lower die 103B and the lower die 103B is positioned under the upper die 103A as shown in FIGS. 1A and 1B. As shown in FIGS. 1 A and 1B, the connector 107 is placed on the lower die 103B for crimping.

In one embodiment, each die 103 includes a plurality of alternating rows of impression teeth and indentations. The alternating rows of impression teeth are used to form the impressions on the connector 107 positioned within the crimp tool 100 as described in detail with respect to FIG. 2. Each die 103 includes at least two rows of impression teeth to form at least two impressions on the connector 107.

Figure 2:
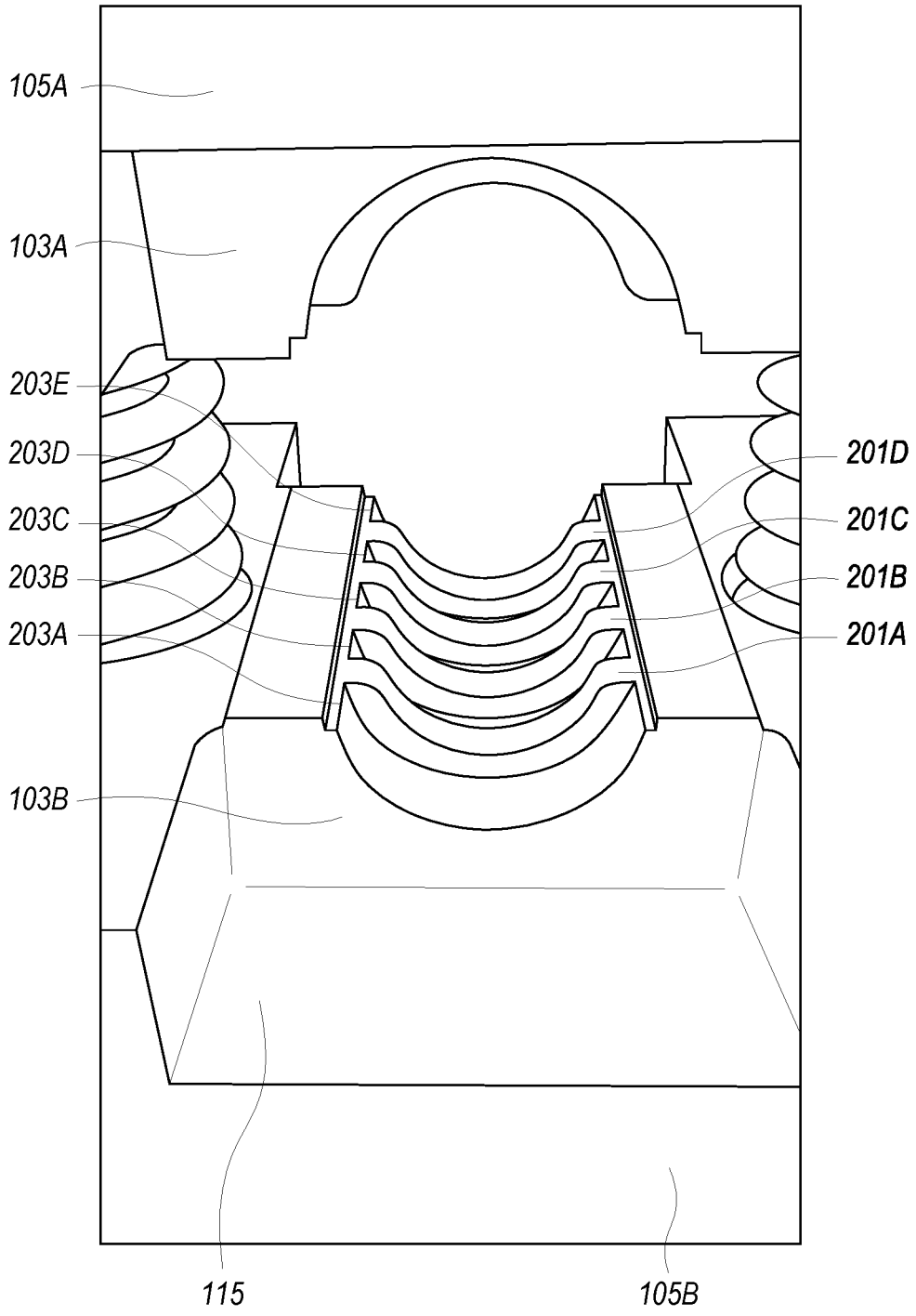
FIG. 2 illustrates a detailed view of the die included in the crimping tool according to one embodiment.

FIG. 2 illustrates a detailed view of the lower die 103B according to one embodiment. Note that the upper die 103A is substantially identical to the lower die 103B and the description of the lower die 103B is applicable to the upper die 103A. The lower die 103B is a metal block such as steel that is rectangular in shape. The lower die 103B includes impression teeth 201A, 201B, 201C, and 201D and indentations 203A, 203B, 203C, 203D, and 203E formed along the length of the lower die 103B. The impression teeth 201 and the indentations 203 are alternately formed such that each impression tooth 201 is positioned between a pair of indentations 203. The impression teeth 201 and indentations 203 are formed by milling the impression teeth 201 and indentations 203 into the lower die 103 using a milling machine for example. Compared to the indentations 203, the impression teeth 201 are formed with a smaller radius than the indentations 203 so that the impression teeth 201 protrude from the die 103. As shown in FIG. 2, the impression teeth 201 and indentations 203 are formed with a "U" shape. Lower die 103B and upper die 103B are considered "U-die" given the shape of the impression teeth 201A and indentations 203B. Note that in other embodiments, other die shapes may be used.

Figure 3:
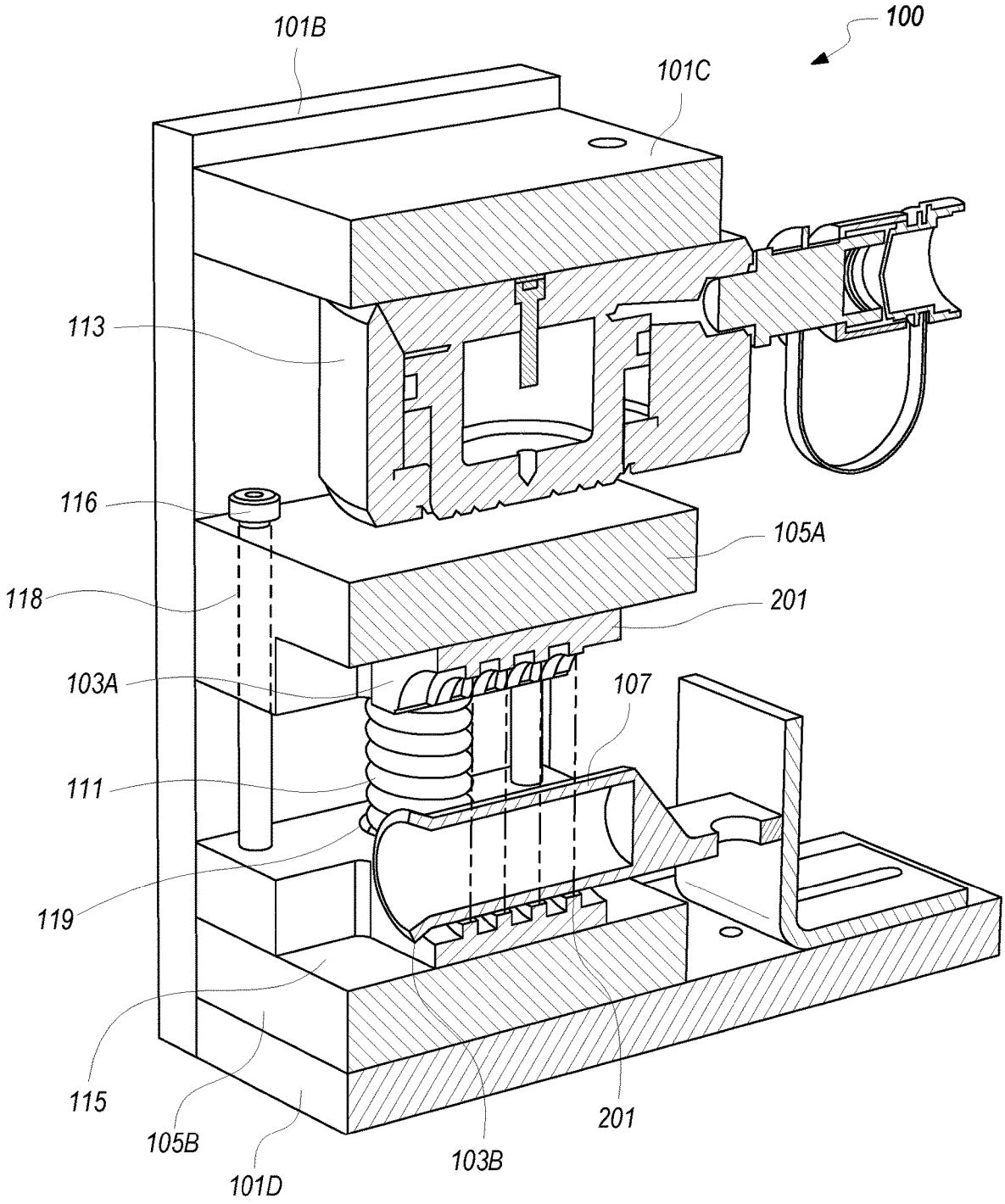
FIG. 3 illustrates a cross-sectional view of the crimping tool according to one embodiment.

Referring to FIG. 3, a cross-sectional view of the crimp tool 100 is shown according to one embodiment. Each impression tooth 201 of the upper die 105A is vertically aligned with a corresponding impression tooth of the lower die 105B. By aligning the impression teeth 201 of the upper die 105A and the lower die 105B, the impression teeth can 201 form impressions on the connector 107 when the die 105 are clamped around the connector 107.

In one embodiment, at least one of the upper die 103A and lower die 103B include an imprint of the die index associated with the die 103. The die index is an industry standard that specifies the specific die and metal (e.g., wire) that should be used with the connector 107. In one embodiment, the imprint on one of the upper die 103A and the lower die 103B is a protrusion that causes the logo of the die index to be imprinted upon the connector 107 when the die 103 are compressed around the connector 107. Each die may include a single imprint of the die index or multiple imprints of the die index.

Referring back to FIGS. 1A and 1B, the crimp tool 100 also includes a plurality of die holders 105 that are configured to hold the plurality of die 103. Specifically, the crimp tool 100 includes an upper die holder 105A and a lower die holder 105B. Each die holder 105 is configured to connect to a corresponding die 103 from the plurality of die mentioned above. For example, upper die holder 105A is connected to upper die 103A and lower die holder 105B is connected to die 103B. Each die 103 may be connected to its corresponding die holder 105 via a connecting mechanism such as a cam spring detent. The connecting mechanism is used to connect and disconnect a die holder 105 from a die 103. Since each die holder 105 is configured to be detachable from its corresponding die, the die holders 105 can be connected to die having different die indexes that are required depending on the size of the connector 107 needing crimping.

In one embodiment, the die holders 105 are made of metal such as steel. However, the die holders 105 may be made of other types of metal in other embodiments. The die holders 105 are rectangular in shape and each die holder 105 includes a slot 115 along the length of the die holder 105. In one embodiment, a die 103 is connected to a die holder 105 within the slot 115 of the die holder 105. The slot 115 is created in each die holder 105 my milling out a portion of the die holder 105.

In one embodiment, each die holder 105 includes a spring hole 119 at each side of the slot for placement of springs 111. For example, a first spring hole is formed to the left of the slot 115 between the ends of the die holder 105 and a second spring hole is formed to the right of the slot 115 between the ends of the die holder 105. Each spring hole 119 is formed only partially through the thickness of the die holder 105 such as halfway through the thickness of the die holder 105.

In one embodiment, the lower die holder 105B is connected to the housing 101 via fasteners 109 such as screws and rivets. As shown in FIG. 1B, the lower die holder 105B is in contact with the right wall 101A, left wall 101B, and bottom wall 101 D of the housing 101. The lower die holder 105 has a width that is slightly smaller than the opening width of the housing 101. By having a slightly smaller width than the opening width of the housing 101, the lower die holder 105B has a tight fit within the housing so that the lower die holder 105B does not move while the crimp tool 100 is in use.

As shown in FIGS. 1A and 1B, the upper die holder 105A is positioned over the lower die holder 103B. In one embodiment, the upper die holder 105A is narrower in width than the lower die holder 105B. The upper die holder 105A is narrower in width than the lower die holder 105 as the upper die holder 105A requires freedom to move in the vertical direction in order to press the upper die 103A onto the connector 107.

The upper die holder 105A is supported by a plurality of springs 111 that are placed within the spring holes formed in the upper and lower die holders 105. The plurality of springs 111 respectively support the left and right sides of the upper die holder 105B so that the upper die holder 105 is suspended above the lower die holder 105B. The springs 111 return the upper die holder 105A to the open position as shown in FIGS. 1A and 1B after the upper die holder 105A is compressed by the hydraulic cylinder 113 described below. The springs 111 may have a spring force of 200-250 lb/ft in one embodiment.

For example, a first spring 111A includes a first end and a second end. The first end of the first spring 111A is placed into the first spring hole in the upper die holder 105A and the second end of the first spring 111A is placed into the first spring hole in the lower die holder 105B. Similarly, the first end of the second spring 111B is placed into the second spring hole in the upper die holder 105A and the second end of the second spring 111B is placed into the second spring hole in the lower die holder 105B.

The upper die holder 105A is secured over the springs 111 via alignment bolts 116. In one embodiment, each alignment bolt 116 is arranged through an alignment bolt hole 118 in each corner of the upper die holder 105A and is threaded into a corresponding alignment bolt hole located in a corner of the lower die holder 105B. The alignment bolts 116 may be torqued with enough force to slightly compress the springs 111 (e.g., 10 lb/ft).

Figure 4:
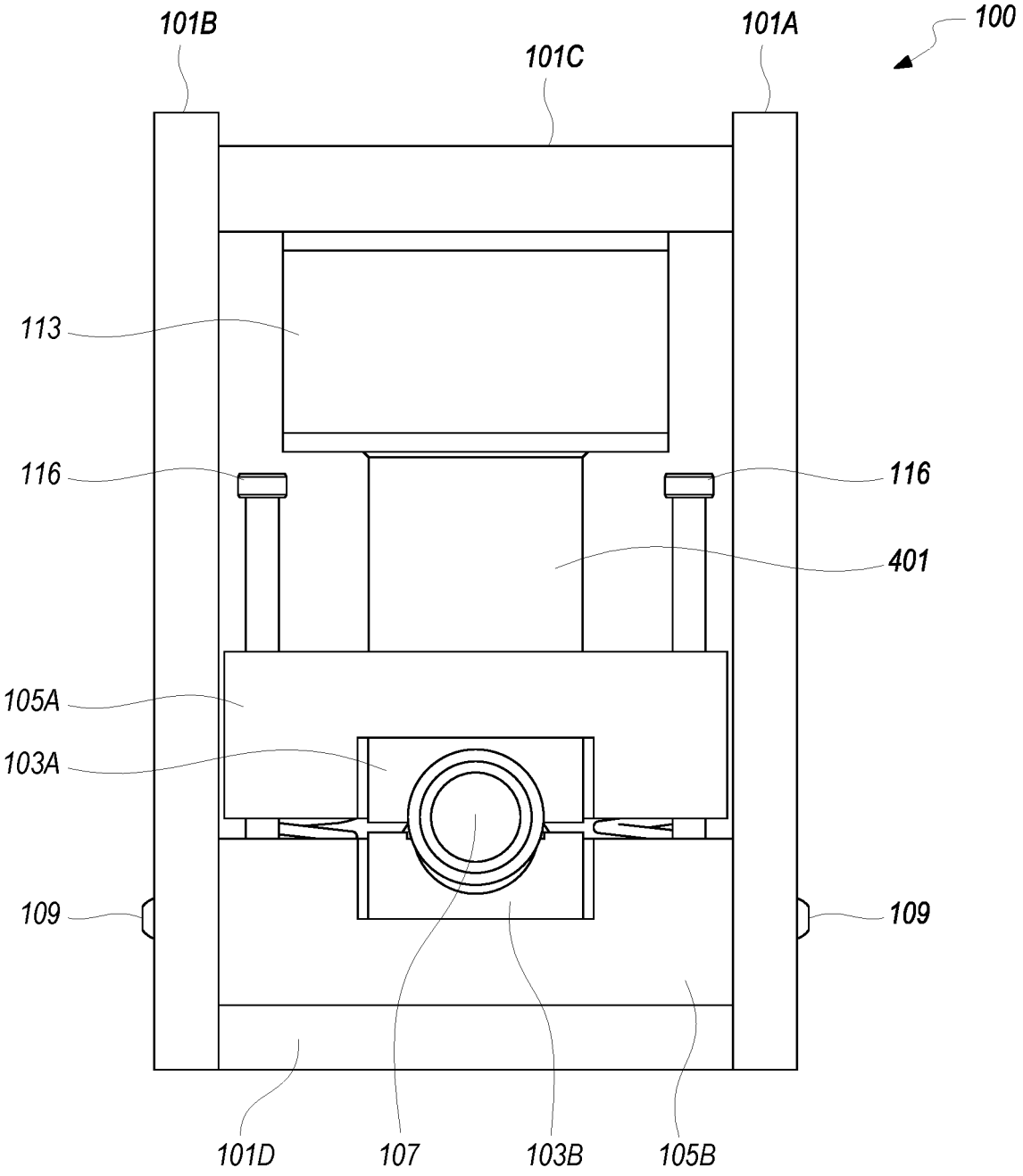
FIG. 4 illustrates a frontal view of the crimping tool in the closed position according to one embodiment.

As mentioned above, the crimp tool 100 further includes a hydraulic cylinder 113 that applies force to the upper die holder 105A. Although a hydraulic cylinder is used in the crimp tool, other types of cylinders may be used such as a pneumatic cylinder. The hydraulic cylinder 113 applies force to the upper die holder 105A via a piston 401 that extends from the hydraulic cylinder 113 as shown in FIG. 4. The hydraulic cylinder 113 may apply up to 50 tons of force to the upper die holder 105A. The hydraulic cylinder 113 may be connected to the upper wall 101C via fasteners.

Figure 5:
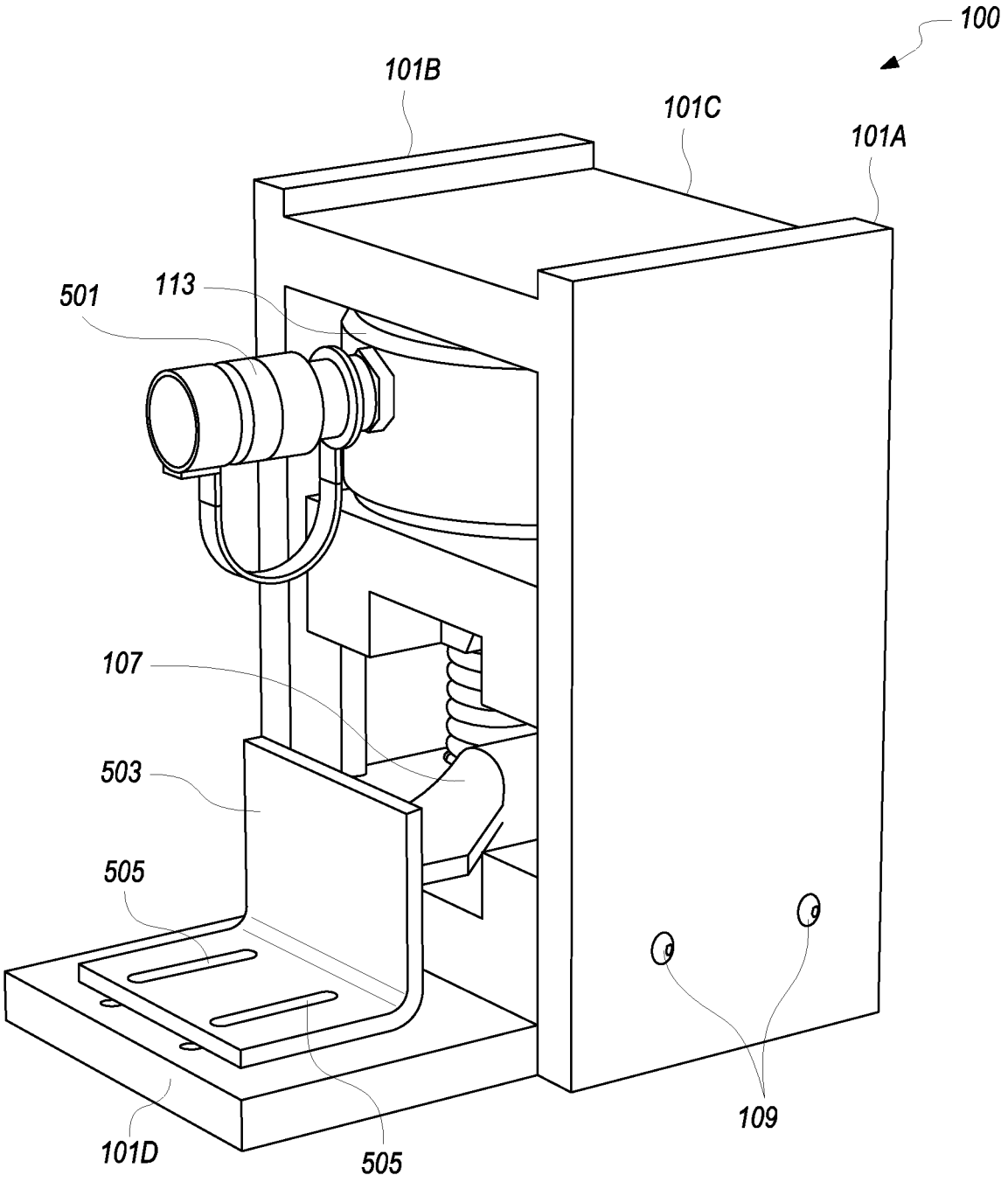
FIG. 5 illustrates an isometric rear view of the crimping tool according to one embodiment.

Referring to FIG. 5 showing an isometric rear view of the crimp tool 100, the hydraulic cylinder 113 includes a hydraulic coupler 501 for connecting the hydraulic cylinder 113 to a hydraulic hose (not shown). As the hydraulic hose applies hydraulic fluid to the hydraulic cylinder 113, hydraulic fluid within the hydraulic cylinder 113 is displaced thereby causing the piston 401 to extend from the hydraulic cylinder 113 shown in FIG. 4. As the piston 401 extends from the hydraulic cylinder 113, the piston 401 moves the upper die holder 105A vertically downward. The alignment bolts 116 guide the upper die holder 105A in a vertical manner as the piston 401 applies force to the upper die holder 105A. That is, the alignment guide bolts 116 guide the upper die holder 105A along a pre-determined vertical path that corresponds to the length of the alignment bolts 116.

The hydraulic cylinder 113 moves the upper die holder 105A from the open position shown in FIGS. 1A and 1B to the closed position shown in FIG. 4 as the piston 401 applies force to the upper die holder 105A. In the closed position of the crimp tool 100, the impression teeth 201 of the upper and lower die 103 clamp around the connector 107 and squeeze the connector 107 thereby forming a plurality of impressions around the connector 107 using a single compression of the connector 107. In one embodiment, the crimp tool 100 is maintained in the closed position for a threshold amount of time (e.g., 5 seconds) before the hydraulic cylinder 113 retracts the piston 401 in order to ensure that the impressions are formed around the connector 107. After the hydraulic cylinder 113 releases pressure, the piston 401 retracts and the spring force of the springs 111 move the upper die holder 105A back to the open position shown in FIGS. 1A and 1B. After the impressions are formed around the connector 107, the connector 107 is now secured to the conductor (e.g., wiring or cable) inserted into the connector 107 from the resulting ridges formed within the conductor and connector 107.

Figure 6:
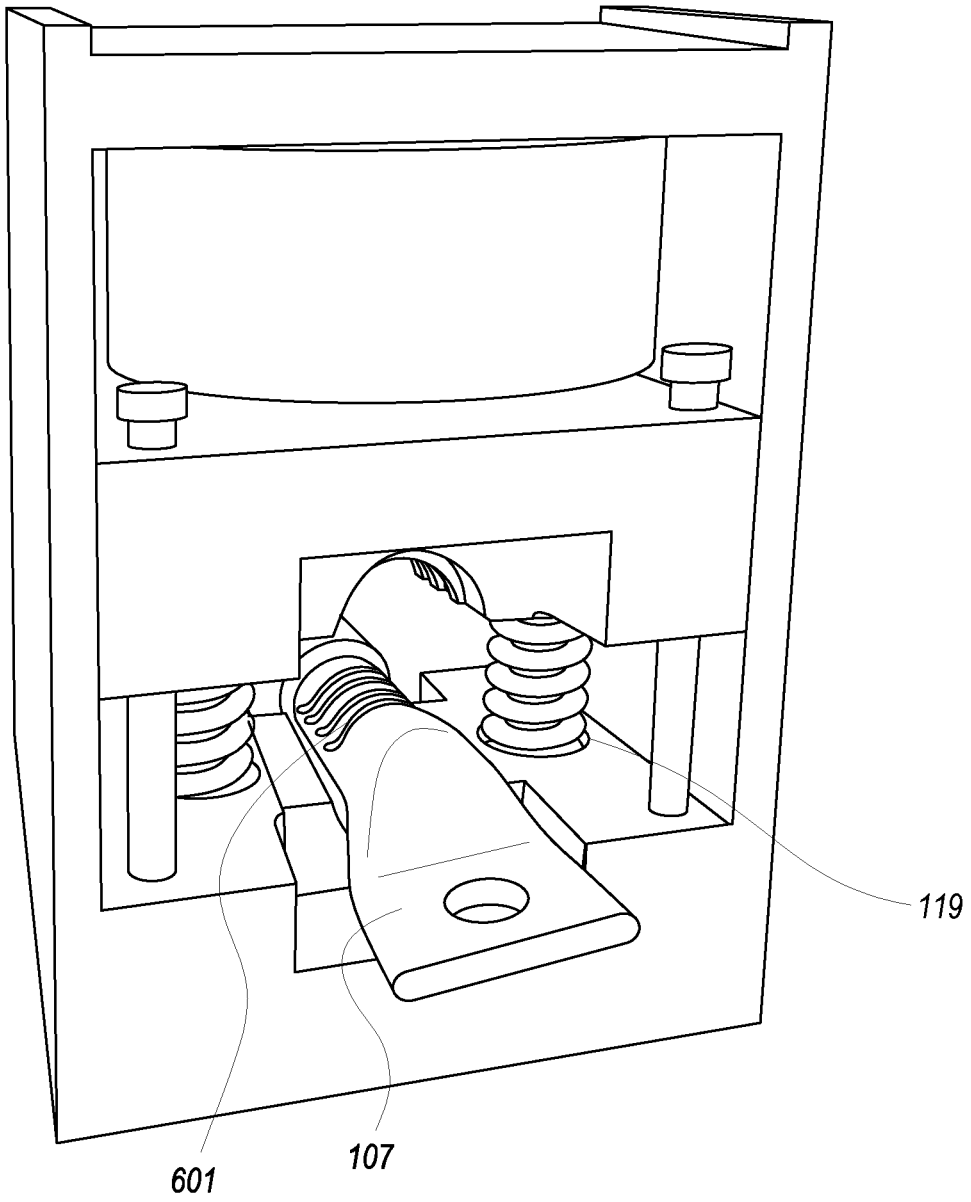
FIG. 6 illustrates a view of the compression lug in the crimping tool according to one embodiment.
Figure 7A:
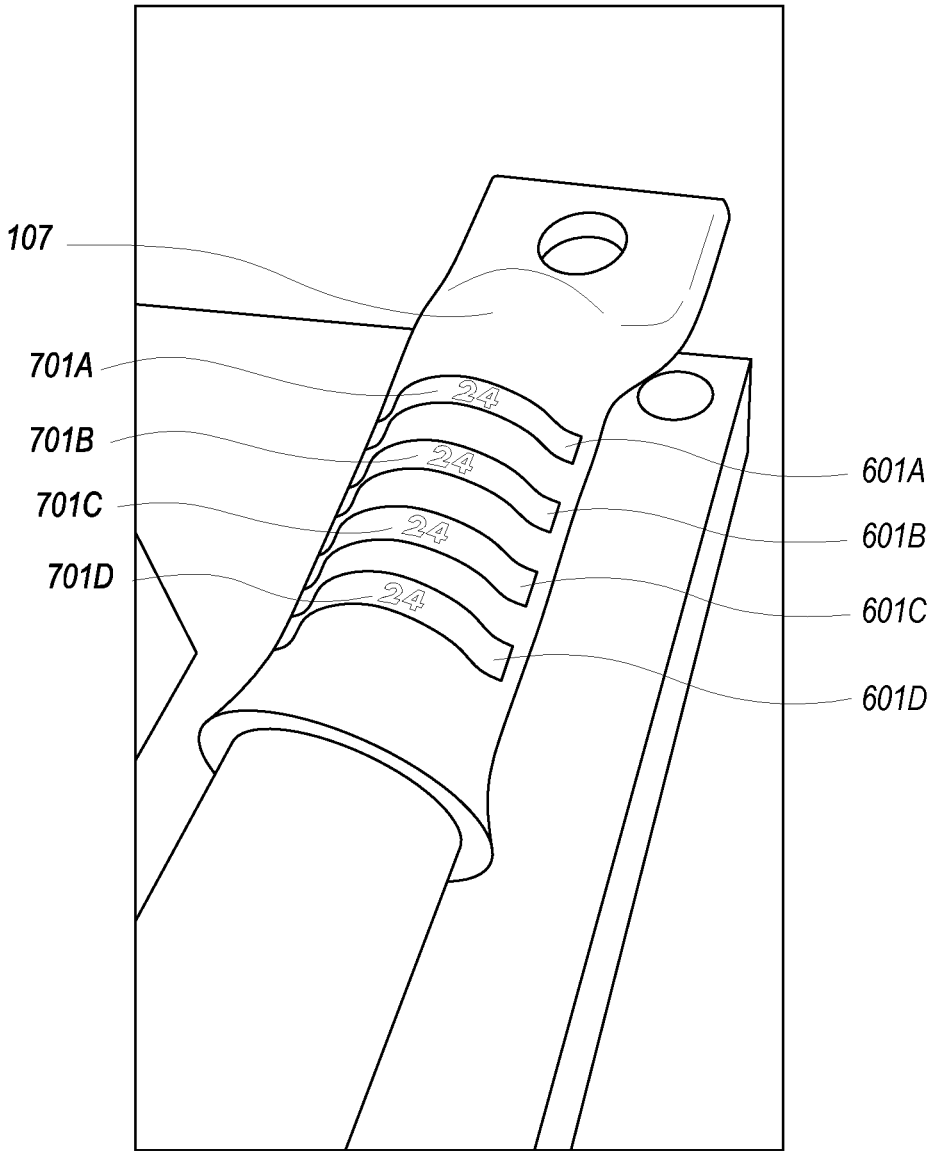
FIGS. 7A and 7B illustrate a different views of the compression lug after crimping according to one embodiment.
Figure 7B:
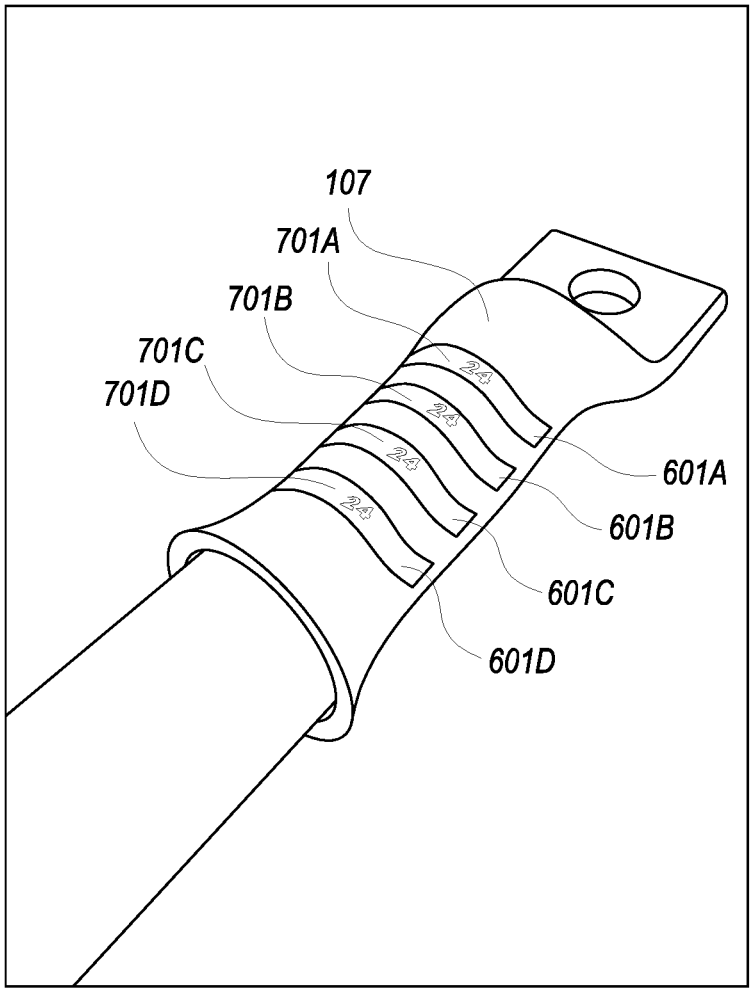

Referring to FIGS. 6 and 7A and 7B, the connector 107 includes a plurality of impressions 601A-601D as a result of the die 103 being compressed around the connector 107. The impressions 601 are evenly spaced apart from each other according to the spacing of the plurality of impression teeth 201 included in the die 103. Furthermore, FIGS. 7A and 7B also illustrate that the connector 107 includes the logo 701 of the die index of the die 103 used to create the impressions 601. By including the logo 701 of die index on the connector 107, a person can visually verify that the correct die was used to crimp the connector 107. As shown in FIGS. 7A and 7B, a plurality of logos (e.g., "24") 701A-701D of the die index of the die used to create the impressions on the connector are included on the connector 107. Each logo 701 is associated with a corresponding impression on the connector 107 and visually indicates the die index of the die used to create the impression on the connector. For example, logo 701D indicates the index of the die used to create impression 601A and logo 701B indicates the index of the die (e.g., "24") used to create impression 601B and so on. Each logo 601 is positioned within the impression on the connector 107. In alternative embodiments, the connector 107 includes a single logo of the die index on the connector 107. In one embodiment, the logo 701 is only included on one side of the connector 107 or is included on both sides of the connector 107.

Referring back to FIG. 5, in one embodiment the crimp tool 100 also includes a positioning platform 503. The positioning platform 503 is made of metal such as steel, but can be made of any type of metal. In one embodiment, the positioning platform 503 has a horizontal part and a vertical part that are positioned 90 degrees from each other to form an "L" shape. The horizontal part includes slots 505 through the thickness of the positioning platform 603 and span across a width of the horizontal part (e.g., 75 percent of the width). The horizontal part of the positioning platform 503 is connected to the lower wall 101D of the housing 101 via fasteners placed through the slots 505.

In one embodiment, the positioning platform 503 is used to move the connector 107 into the correct position for crimping within the crimping tool 100. One end of the connector 107 is abutted against the positioning platform 503 and the positioning platform 503 is moved horizontally to position of the connector 107 within the crimping tool 100. The slots 505 function as a guide to restrict the movement of the positioning platform 503 along a predetermined path.

Method for Single Compression, Multiple Impression Crimping

Figure 8:
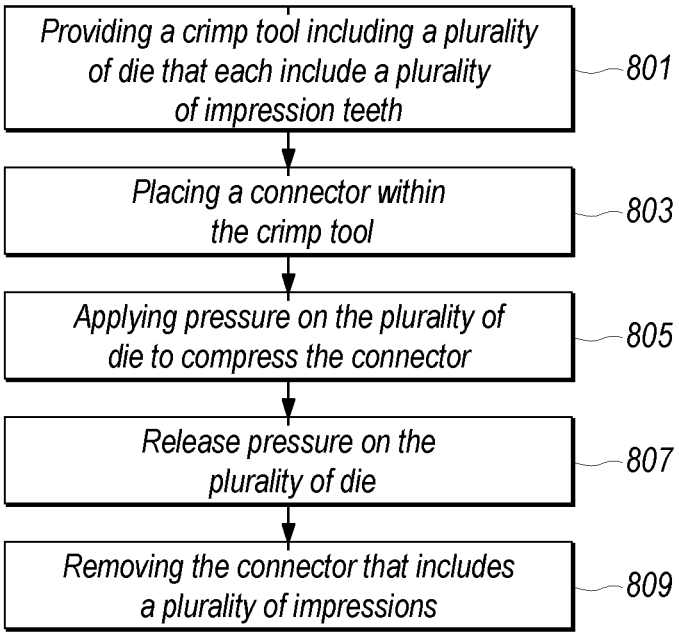
FIG. 8 illustrates a method of crimping metal using the crimping tool according to one embodiment.

FIG. 8 illustrates one embodiment of a method for crimping a connector using the crimp tool 100 shown in FIGS. 1 through 7. Note that in other embodiments, additional steps may be included other than the steps shown in FIG. 8.

In one embodiment, the method for crimping a connector 107 includes providing 801 a crimp tool 100 that includes a plurality of die 103 where each die includes a plurality of impression teeth 201. The plurality of die 103 include an upper die 103A and a lower die 103B. The plurality of impression teeth 201 are used to create multiple impressions on the connector 107. The connector 107 is placed 803 within the crimp tool 100. Specifically, the connector 107 is placed on the lower die 103B. Pressure is applied 805 on the plurality of die 103 to compress the connector 107. That is, the hydraulic cylinder 113 applies 805 pressure to a piston 401 that presses down on the upper die 103A. As the upper die 103A is pressed downward, the impression teeth 201 of the upper die 103A contact the connector. As pressure is applied to the die, the impression teeth 201 of the upper die 103A and the lower die 103B form impressions around the connector 107. The impressions secure the connector 107 to a wire or cable that is inserted in the connector. The pressure is released 807 from the plurality of die 103 after the impressions are made around the connector 107. The connector 107 is then removed 807 from the crimp tool 100.

Although this description has been provided in the context of specific embodiments, those of skill in the art will appreciate that many alternative embodiments may be inferred from the teaching provided. Furthermore, within this written description, the particular naming of the components, capitalization of terms, the attributes, data structures, or any other structural or programming aspect is not mandatory or significant unless otherwise noted, and the mechanisms that implement the described invention or its features may have different names, formats, or protocols.

Finally, it should be noted that the language used in the specification has been principally selected for readability and instructional purposes, and may not have been selected to delineate or circumscribe the inventive subject matter. Accordingly, the disclosure is intended to be illustrative, but not limiting, of the scope of the invention.

What is claimed is:

1. A crimp tool comprising:

a metal housing;

a hydraulic cylinder within the metal housing, the hydraulic cylinder including a piston configured to extend from the hydraulic cylinder;

a first die holder within the metal housing, the first die holder comprising a plurality of first alignment bolt holes and at least one first spring hole positioned between a pair of first alignment bolt holes from the plurality of first alignment bolt holes, wherein the first spring hole in its entirety is non-overlapping with the plurality of first alignment bolt holes;

a second die holder under the first die holder within the metal housing, the second die holder comprising a plurality of second alignment bolt holes and at least one second spring hole positioned between a pair of second alignment bolt holes from the plurality of second alignment bolt holes, wherein the second spring hole in its entirety is non-overlapping with the plurality of second alignment bolt holes, wherein each of the plurality of second alignment bolt holes is aligned with a corresponding one of the plurality of first alignment bolt holes, and the second spring hole is aligned with the first spring hole, wherein the first die holder is configured to move towards the second die holder responsive to the piston extending from the hydraulic cylinder;

a plurality of alignment bolts, each alignment bolt through a corresponding one of the plurality of first alignment bolt holes and a corresponding one of the plurality of second alignment bolt holes that is aligned with the corresponding one of the plurality of first alignment bolt holes;

a first spring having a first end and a second end, the first end positioned in the first spring hole in the first die holder, and the second end positioned in the second spring hole in the second die holder; and a first die positioned within the first die holder and a second die positioned within the second die holder, the first die and the second die each including a plurality of impression teeth, wherein the plurality of impression teeth of the first die are aligned with the plurality of impression teeth of the second die;

wherein a metal connector is positioned between the plurality of impression teeth of the first die and the second die; and wherein a plurality of impressions are formed around the metal connector responsive to the hydraulic cylinder pressing the piston against the first die holder causing the first die holder to move towards the second die holder such that the first die and the second die are clamped around the metal connector.

2. The crimp tool of claim 1, wherein the first die and the second die each include a plurality of indentations where each impression tooth from the plurality of impression teeth is between a pair of indentations from the plurality of indentations.

3. The crimp tool of claim 1, wherein at least one of the first die and the second die include at least one imprint of a die index associated with the first die and the second die.

4. The crimp tool of claim 1, wherein at least one imprint of a die index is formed on the connector responsive to the first die and second die clamping around connector.

5. The crimp tool of claim 1, wherein the metal housing comprises:

a first horizontal wall including a first end and a second end;

a second horizontal wall under the first horizontal wall, the second horizontal wall including a first end and a second end;

a first vertical wall between the first end of the first horizontal wall and the first end of the second horizontal wall; and a second vertical wall between the second end of the first horizontal wall and the second end of the second horizontal wall.

6. The crimp tool of claim 5, wherein the first die holder includes a slot, and the first die is positioned within the slot of the first die holder; and wherein the second die holder includes a slot, and the second die is positioned within the slot of the second die holder.

7. The crimp tool of claim 6, wherein the second die holder is in contact with the second horizontal wall, the first vertical wall, and the second vertical wall of the metal housing, and wherein the first die holder is not in contact with the metal housing.

8. The crimp tool of claim 6, wherein the second die holder is fastened to the first vertical wall and the second vertical wall using fasteners.

9. The crimp tool of claim 6, wherein the plurality of first alignment bolt holes are at corners of the first die holder and the plurality of second alignment bolt holes are at corners of the second die holder.

10. The crimp tool of claim 1, further comprising:

a second spring including a first end and a second end;

wherein the first die holder includes a third spring hole and the second die holder includes a fourth spring hole that is aligned with the third spring hole, and the first end of the second spring is positioned in the third spring hole in the first die holder and the second end of the second spring is positioned in the fourth spring hole in the second die holder.

11. The crimp tool of claim 5, wherein the second horizontal wall is longer than the first horizontal wall and includes a portion that extends past the first vertical wall and the second vertical wall.

12. The crimp tool of claim 11, further comprising:

a positioning platform connected to the portion of the second horizontal wall that extends past the first vertical wall and the second vertical wall, the positioning platform configured to abut against the connector and moves horizontally to position the connector between the first die and second die.

13. The crimp tool of claim 12, wherein the positioning platform includes a horizontal part and vertical part, the horizontal part including a plurality of slots;

wherein the horizontal part of the positioning platform is fastened to the portion of the second horizontal wall that extends past the first vertical wall and the second vertical wall via fasteners through the slots.

14. The crimp tool of claim 1, wherein the first die and the second die are U-die.

15. The crimp tool of claim 6, wherein the housing, the first die, the second die, the first die holder, and the second die holder are made of metal.

16. The crimp tool of claim 15, wherein the metal is steel.

17. The crimp tool of claim 1, wherein the hydraulic cylinder is configured to apply 50 tons of pressure on the first die via the piston.

* * * * *